US007367698B2

(12) United States Patent
Miller

(10) Patent No.: US 7,367,698 B2
(45) Date of Patent: May 6, 2008

(54) HAND-HELD PORTABLE DROP LIGHT

(76) Inventor: Thomas J. Miller, 750 N. Diamond Bar Blvd., Suite 220, Diamond Bar, CA (US) 91765

( * ) Notice: Subject to any disclaimer, the term of this patent is extended or adjusted under 35 U.S.C. 154(b) by 0 days.

(21) Appl. No.: 11/389,551

(22) Filed: Mar. 23, 2006

(65) Prior Publication Data

US 2006/0250791 A1 Nov. 9, 2006

Related U.S. Application Data

(60) Provisional application No. 60/665,427, filed on Mar. 24, 2005, provisional application No. 60/665,207, filed on Mar. 25, 2005.

(51) Int. Cl.
*F21V 21/10* (2006.01)
*F21V 14/02* (2006.01)

(52) U.S. Cl. ..... 362/429; 362/287; 362/260; 362/220; 362/427

(58) Field of Classification Search ..... 362/197, 362/198, 199, 260, 371, 372, 377, 427, 451, 362/220, 226, 285, 287, 429
See application file for complete search history.

(56) References Cited

U.S. PATENT DOCUMENTS 2,100,042 A * 11/1937 Travis ..... 313/49
4,432,043 A 2/1984 Yuen
4,546,419 A 10/1985 Johnson
4,744,767 A * 5/1988 Henrici et al. ..... 439/226
4,748,548 A * 5/1988 Barton ..... 362/249
4,958,267 A * 9/1990 Baake ..... 362/399
5,023,765 A * 6/1991 Barton ..... 362/429
5,564,821 A * 10/1996 Hesprich ..... 362/378
5,727,871 A * 3/1998 Kotloff ..... 362/225
5,738,438 A 4/1998 Hesprich
D409,776 S 5/1999 Ghode et al.
5,921,658 A * 7/1999 Kovacik et al. ..... 362/199
6,123,434 A * 9/2000 Meltzer ..... 362/260
D458,400 S * 6/2002 Kovacik et al. ..... D26/50
6,663,265 B2 12/2003 Kovacik et al.
6,722,774 B2 4/2004 Kovacik et al.
2006/0109660 A1 * 5/2006 Wolf et al. ..... 362/365

* cited by examiner

*Primary Examiner*—Jacob Y. Choi
(74) *Attorney, Agent, or Firm*—Knobbe, Martens Olson & Bear, LLP

(57) ABSTRACT

A hand-held portable drop-light is provided. The light comprises a handle, a housing, a cover, a novel mounting assembly, and a light bulb. The mounting assembly is configured with a pivoting light bulb socket and positioned within the handle for mounting the light bulb within a housing interior. The housing possesses an aperture through which the container interior and light bulb may be accessed. The cover is reversibly attached to the housing so as to inhibit access to the light bulb through the aperture. When replacing the light bulb, the cover is moved from the aperture and the mounting assembly is pivoted between a retracted position, where the bulb is substantially retained within the housing and an extended position, where a portion of the bulb is positioned outside the housing. In this manner, the light bulb is easily accessed for replacement.

9 Claims, 7 Drawing Sheets

HAND-HELD PORTABLE DROP LIGHT

CROSS-REFERENCE TO RELATED APPLICATIONS

This application claims the benefit of priority under 35 U.S.C. §119(e) of U.S. Provisional Applications 60/665,427 filed on Mar. 24, 2005 entitled HAND HELD PORTABLE ANGLE LIGHT and 60/665,207 filed on Mar. 25, 2005 entitled HAND HELD PORTABLE ANGLE LIGHT, the entirety of which are incorporated herein by reference.

BACKGROUND OF THE INVENTION

1. Field of the Invention

This invention relates generally to hand-held, portable drop-lights and, in particular, to a drop light possessing a moveable lamp socket to facilitate easy and safe light bulb replacement.

2. Description of the Related Art

The need often arises in homes and shops to illuminate areas that are not adequately illuminated by installed light fixtures. Flashlights are sometimes used in these circumstances, however, flashlights generally offer less illumination than hardwired lights. Further, the light from a flashlight is typically focused, whereas diffused illumination is often required. In order to circumvent these problems, portable drop-lights are often utilized.

Generally, drop-lights utilize incandescent or fluorescent bulbs. Fluorescent bulbs are often preferred, as they are more efficient than incandescent bulbs. A fluorescent bulb can produce between 50 and 100 lumens per watt, compared to an incandescent bulb, which produces around 15 lumens per watt. Additionally, fluorescent bulbs typically operate at a cooler temperature than incandescent bulbs, making the drop-light easier to handle.

In general, a fluorescent drop-light consists of a housing, a handle, a bulb socket, a fluorescent bulb, a cover, and electrical components. The housing is hollow, with an opening at the top of the handle which allows access to a hollow area in which the bulb is placed. Inside the housing, the fluorescent bulb is inserted into the socket, which is located near the top of the handle. The cover is secured to the housing to protect the fluorescent bulb. Electrical components, which communicate with a source of electrical power, are also typically found within the handle.

A common problem with fluorescent drop-lights is that spent fluorescent bulbs are difficult to replace. In order to change a spent bulb, the bulb is removed from the socket. The hollow in which the bulb resides, though, is typically only slightly larger than the bulb itself, making it difficult for a user to insert their fingers within the opening to remove a spent bulb, especially if the user has big hands and/or fingers. Furthermore, as drop-lights are often used within industrial and home garage environments, there is a significant likelihood that oil or another slick liquid may reside on the hands of the user, further increasing the difficulty of removing a spent bulb from the drop-light housing. Given the difficulty of removing the bulb, the user may become impatient and utilize excessive force to free the bulb, breaking the bulb in the process. Broken fluorescent bulbs are a danger to the user, due to the risk of injury from broken glass, as well as from exposure to mercury contained within the bulb.

One solution to the bulb removal problem is to enlarge the housing to allow the user greater room to grip the bulb within the housing. However, enlarging the housing generally increases the overall size and weight of the portable hand-held drop-light, making the light more cumbersome. Further, the cost of manufacturing the light could rise due to of the expense of additional material to fabricate the housing.

Other attempts to solve this problem have also been unsatisfying. For example, U.S. Pat. No. 6,123,434 to Meltzer ("Meltzer") addresses the issue of replacing bulbs in fluorescent drop lights by creating a drop-light in which possesses a lampholder lens which fits within the housing opening and provides a socket for placement of the bulb. The lampholder lens and lamp pivot together as much as 90 degrees along two arcuate tracks located within the housing to allow a user access to the bulb outside the housing.

The Meltzer design exposes the user to several dangers during use, however. When the Meltzer lampholder lens and bulb are pivoted to a 90 degree angle, the electrical components may become exposed to the user. If the electrical components are connected to an electrical power source when the user changes the bulb, the user can be exposed to risk of electrical shock from the exposed electrical components.

Further, Meltzer does not teach an easier way to change the bulb. Despite that the bulb and lampholder lens pivot to expose the bulb outside the housing, the bulb is still surrounded by the lampholder lens, as the two are interconnected and move together. Because the space between the lampholder lens and the bulb is typically small, the user must remove the bulb with unobstructed access to only one side of the bulb. Thus, a light employing the Meltzer design still presents the user with difficulty accessing the bulb for removal, with the attendant problems discussed above.

Moreover, the Meltzer design may become more difficult to use over time. Drop-lamps are often used in relatively dirty environments and the arcuate tracks used to pivot the lampholder lens and bulb are exposed to the environment when pivoting the bulb and lens. Hence, dust and debris may get into the tracks, preventing the lampholder lens from sliding easily along the arcuate tracks to move the lampholder lens in and out the housing. As a result, the user may use force to move the lens and damage the lampholder lens and/or bulb.

From the foregoing, it can be seen that there is a continuing need for a portable hand-held drop-light that allows for easy and safe replacement of fluorescent bulbs. To this end, there is a need for a lamp that allows the user greater access to spent bulbs for easier replacement and limits exposure of the user to potentially energized electronic components.

SUMMARY OF THE INVENTION

In one aspect, the preferred embodiments of the invention provide a hand-held portable drop light. The light comprises a handle having a first and a second end which define a handle interior accessible through an opening formed in the first end. The light further comprises a housing interconnected to the first end of the handle, where the housing defines a housing interior dimensioned so as to accommodate a light bulb. An aperture is also formed within the housing that allows access to the handle interior. The light additionally comprises a cover which is configured to move between an engaged position, where the cover substantially inhibits access to the housing interior through the aperture, and a disengaged position where the cover permits access to the housing interior through the aperture. The light also comprises a mounting assembly which is positioned adjacent to the handle opening, configured to removeably retain the light bulb. The mounting assembly is moveable between a retracted position, where the light bulb is positioned substantially within the housing interior, and an extended position, where at least a portion of the light bulb extends through the aperture when the cover is in the disengaged position, to permit a user to grasp the light bulb from at least two sides to remove the light from the mounting assembly for replacement purposes.

In another aspect, the preferred embodiments of the present invention provide a hand-held portable drop light. The light comprises a handle having a first and a second end which define a handle interior accessible through an opening formed in the first end and where the handle further houses a plurality of electrical components for operation of the light. The light further comprises a housing interconnected to the first end of the handle, where the housing defines a housing interior dimensioned so as to accommodate a light bulb An aperture is formed within the housing which allows access to the handle interior. The light additionally comprises a cover, configured so as to move between an engaged position, where the cover substantially inhibits access to the housing interior through the aperture, and a disengaged position, where the cover permits access to the housing interior through the aperture. The light also comprises a mounting assembly which is positioned adjacent to the handle opening. The mounting assembly is configured to removeably retain the light bulb and is moveable between a retracted position, where the light bulb is positioned substantially within the housing interior, and an extended position, where at least a portion of the light bulb extends through the aperture when the cover is in the disengaged position, to permit a user to grasp the light bulb from at least two sides to remove the light from the mounting assembly for replacement purposes. The handle further comprises a lip which inhibits the mounting assembly from moving the light bulb through greater than a predetermined angle from the retracted to extended positions, inhibiting access to the electrical components through the handle opening.

DETAILED DESCRIPTION OF THE PREFERRED EMBODIMENT

Embodiments of the present invention relate to a hand-held, portable drop light for use with fluorescent light bulbs. However, the embodiments of the invention may be used in conjunction with any suitable light bulb. Examples include, but are not limited to, incandescent, halogen, LED, and "black light" bulbs.

Figure 1A:
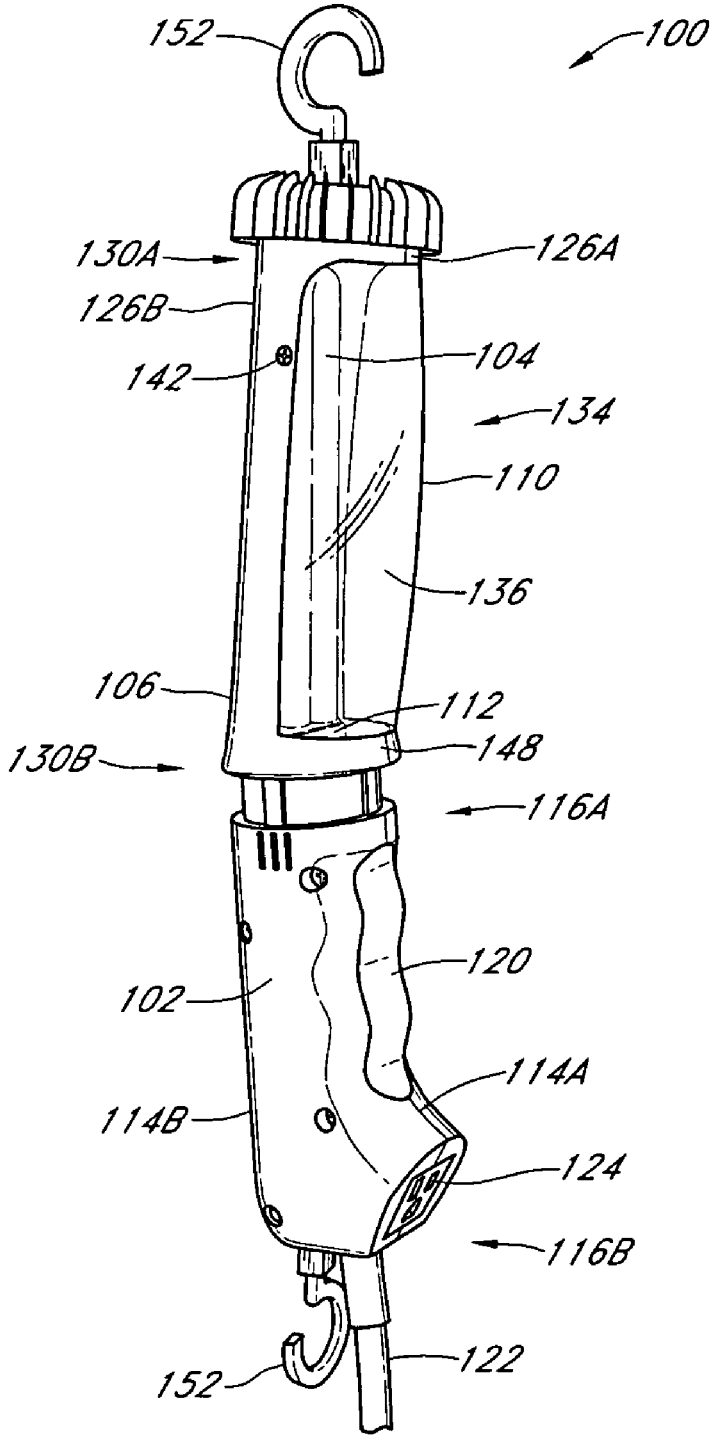
FIG. 1A is a perspective view of one embodiment of the hand-held, portable drop-light, illustrating the light bulb in a retracted position.
Figure 1B:
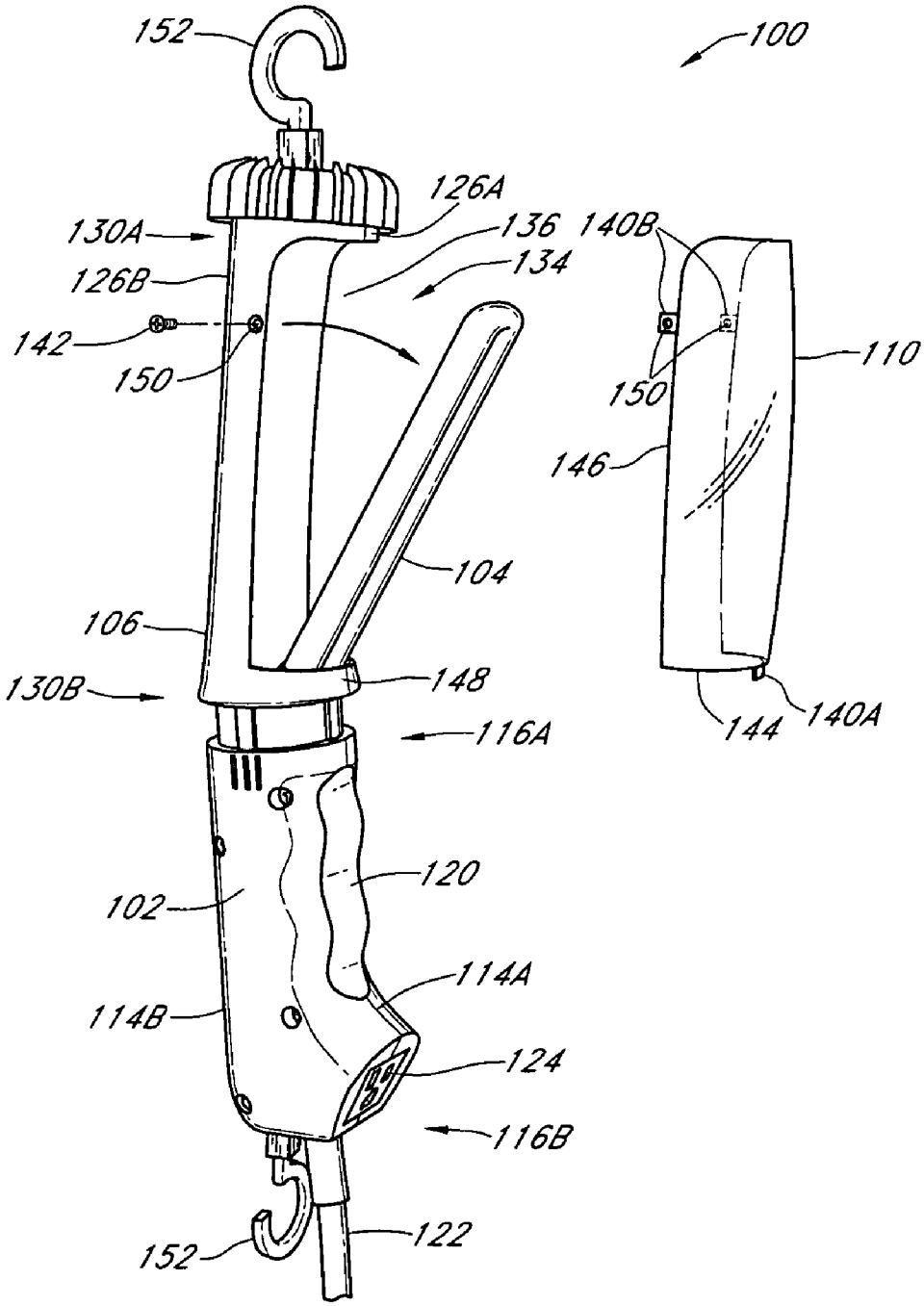
FIG. 1B is a perspective view of the handheld portable light of FIG. 1A, illustrating the light bulb in an extended position.

Reference will now be made to the drawings, wherein like numerals refer to like parts throughout. FIGS. 1A and 1B illustrate perspective views of one embodiment of a hand-held, portable drop-light 100 which provides the user substantially convenient removal and replacement of the light bulb, while concurrently reducing the risk of electrocution. In one embodiment, the light 100 comprises a handle 102 which allows a user to grip the light 100, a light bulb 104 which provides illumination, a housing 106 which contains the light bulb 104, a cover 110 which protects the bulb 104, and a mounting assembly 112 which allows at least a portion of the light bulb 104 to be reversibly moved in and out of the housing 106. As will be described in greater detail below, in certain embodiments, a user removes the cover 110 and moves at least a portion of the light bulb 104 out from the housing 106 in order to access to the light bulb 104 for replacement. Advantageously, the light 100 is configured such that a light bulb 104 so moved is substantially accessible from all sides, allowing the bulb 104 to be easily and safely replaced.

Figure 1C:
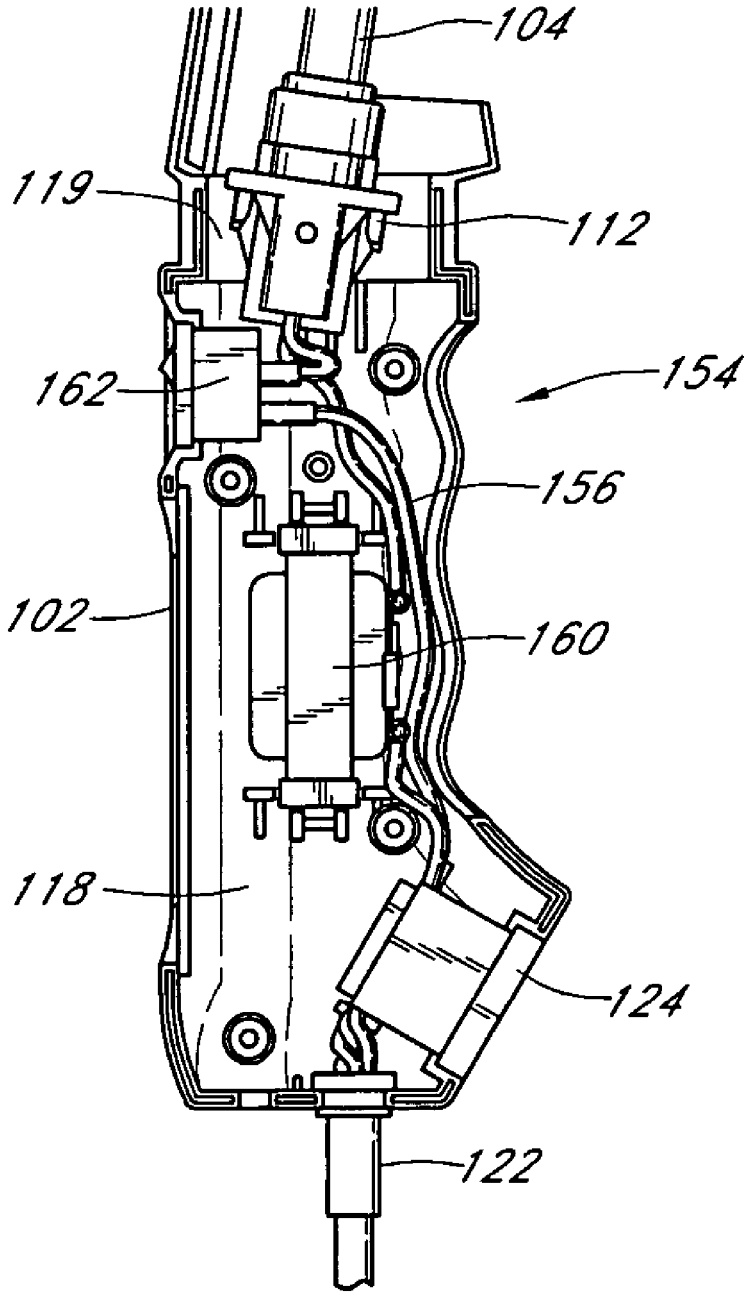
FIG. 1C is a side view of the handheld portable light of FIG. 1A, illustrating the handle interior.

As illustrated in FIGS. 1A-1C, the handle 102 is generally cylindrical and hollow, possessing a first half 114A, a second half 114B, a first end 116A, and a second end 116B, which define a handle interior 118. An opening 119 is also formed in the handle interior 118 to provide a passageway from the handle interior 118 to the housing 106 for placement of the light bulb 104, as discussed below with respect to FIGS. 3A-3B. The handle 102 is generally dimensioned so as to allow a user to grasp the handle 102 within their hand. To facilitate this action, the first half 114A of the handle 102 is configured with finger contours 120 that are designed to engage with the user's fingers and to provide a comfortable, secure grip of the light 100. Further, the second half 114B of the handle 102 is rounded and approximately smooth so as to rest comfortably against the user's palm when the handle 102 is grasped. Electrical components 154 necessary for operation of the light 100 are also housed within the handle 102, as discussed in greater detail below with respect to FIG. 1C.

In one embodiment, an electrical cord 122 and an electrical outlet 124 are also present at the second end 116B of the handle 102. The electrical cord 122 extends outward from the second end 116B of the handle 102 and is in electrical communication with the electrical components 154. The electrical cord 122 is connected to an electrical power source to provide electrical power to the light 100. The electrical outlet 124 is also integrated within the second end 116B of the handle 102, below the contours 120, angled to facilitate access to the outlet 124. When electrical power is provided to the light 100, the electrical outlet 124 functions as a source of electrical power, an advantage in workshops and industrial environments where electrical outlets may be inconveniently located.

Electrical components 154 generally understood for operation of the light 100 are contained within a handle interior 118, as illustrated in FIG. 1C. In one embodiment, the electrical components 154 comprise electrical wires 156, an electrical ballast 160, and an electrical switch 162. The electrical wires 156 electrically interconnect the electrical cord 122, the electrical outlet 124, the electrical ballast 160, the switch 162, and the light bulb 104, while the electrical ballast 160 acts to regulate the electric current entering the light 100 for use by the light bulb 104, and the switch 162 controls the flow of electrical power to the light bulb 104. In this manner, electrical power is provided to the light 100. In a preferred embodiment, the electrical wires 156 pass through the mounting assembly 112 to electrical contacts mounted within the assembly 112, providing electrical power to the light bulb 104. Advantageously, this design substantially inhibit the user's exposure to the electrical components, particularly the wires 156, facilitating safe replacement of the bulb, as discussed in greater detail below with respect to FIGS. 3A-3B.

FIGS. 1A and 1B further illustrate the housing 106. In one embodiment, the housing 106 is generally elongate and hollow, possessing a housing first half 126A and a housing second half 126B, an first end 130A, a second end 130B, and an aperture 134. Together, the housing first and second halves 126A and 126B and the aperture 134 define a housing interior 136 that is dimensioned so as to accommodate and protect the light bulb 104 during use of the light 100. The aperture 134 substantially spans the housing first face 126A and is dimensioned so as to allow at least a portion of the light bulb 104 to emerge from within the housing 106 when the light bulb 104 is moved for replacement, as discussed in greater detail below with respect to FIGS. 3A-3B.

One embodiment of the cover 110 is also illustrated in FIGS. 1A-1B. The cover 110 is generally elongate and U-shaped, dimensioned so as to substantially span the aperture 134 and to prevent objects from passing through the aperture 134 which might damage the bulb 104. The cover 110 is further configured so as to allow passage of light generated by the light bulb 104 and illuminate a designated area. In one embodiment, the cover 110 is transparent, while in an alternative embodiment, the cover 110 is translucent.

In one embodiment, the cover 110 is configured to reversibly move between an engaged position and a disengaged position. In the engaged position, the cover 110 is placed over the aperture 134, inhibiting access to the housing interior 136, as illustrated in FIG. 1A. The cover 110 is placed in the engaged position for protection of the light bulb 104 during use of the light 100. In the disengaged position, the cover 110 is removed from the aperture 134, permitting access to the housing interior 136. In one preferred embodiment, the cover 110 may be completely detached from the housing 106 in the disengaged position, as illustrated in FIG. 1B. In an alternative embodiment, the cover 110 may be substantially removed from the aperture 134 but remain interconnected to the housing 106. The cover 110 is placed in the disengaged position so as to allow access to the light bulb 104 during replacement.

In one embodiment, the cover 110 is removably attached to the housing 106 using a plurality of tabs 140A and 140B integrally formed within the cover 110 and a plurality of screws 142. A first tab 140A is located at a second end 144 of the cover 110, while a second plurality of tabs 140B are located along the side edges 146 of the cover 110. When the cover 110 is in the engaged position, the first tab 140A is positioned substantially within the housing interior 136, adjacent to a frame 148 of the aperture 134. Further, the second plurality of tabs 140B and the housing second half 126B contain integrally formed holes 150 that are substantially aligned when the cover 110 is in the engaged position. The screws 142 are inserted within the holes 150 to secure the cover 110 to the housing 106. Removal of the screws 142 allows the cover 110 to be removed from the aperture 134.

Advantageously, the use of screws 142 and tabs 140A and 140B to secure the cover 110 to the housing 106 provides a damage-resistant hand-held light 100 design. In some hand-held lamp designs, the cover is secured to the housing through locking tabs integrally formed within the cover that engage the housing. Because the locking tabs are designed to disengage from the housing when the tabs are compressed towards each other, an impact to the cover may bend the cover enough to jar the cover loose and expose the light bulb to damage. With screws 142 and tabs 140A and 140B securing the cover to the housing 106, however, there is a higher likelihood of retaining the cover 110 in the aperture 134 and protecting the light bulb 104 from damage, should the cover 110 experience an impact.

In further advantage, the use of the screws 142 and tabs 140A and 140B to secure the cover 110 to the housing 106 is safer than the use of locking tabs. Locking tabs may be circumvented by a child to open the cover and expose the child to the light bulb. This elevates the risk that the child may be injured by the light bulb. When screws 142 are used to secure the cover 110, however, a screwdriver or other tool is necessary to remove the screws 142 from the housing 106 and disengage the cover 110. The screws 142 may be easily removed by an adult but not by a child to gain access to the light bulb 104. In this manner, the design of the light 100 balances convenient access to the light bulb 104 with safety.

Designing the cover 110 to be removed from the housing 106 independently of the light bulb 104 provides a number of advantages. In one advantage, the user is provided substantially unobstructed assess to the light bulb 104 within the housing interior 136. In drop-light designs where the light bulb is mounted to the cover, the cover is removed from the housing to gain access to the light bulb. However, as the cover is often substantially the same size as the light bulb, little space is available for a user to grasp the bulb safely without breaking it. As illustrated in FIG. 1B, however, when the cover 110 is in the disengaged position, the cover 110 is substantially separated from the light bulb 104. This allows the user adequate space in order to access the light bulb 104 within the housing interior 136 and, as described in greater detail below with respect to FIGS. 3A-3B, to move the light bulb 104 into the extended position for easy removal.

In another advantage, a damaged cover 110 of the light 100 may be replaced at lower cost than in other drop-light designs. In some drop-light designs, the light bulb is mounted to the cover through an interconnected socket. In these designs, the cover and the interconnected socket must both be replaced when the cover is replaced. The cost of replacing a damaged cover 110 by itself is generally less than that of replacing a cover integrated with the socket, reducing the lifetime operating costs of the light 100.

FIGS. 1A-1B also illustrate a plurality of attachment members 152 that are integrated within the light. In one embodiment, the attachment members 152 comprise hooks which are interconnected to the housing first end 130A and the handle second end 116B. The hooks allow the light 100 to be hung in a desired area for illumination, allowing the user to free their hands for task work.

Figure 2A:
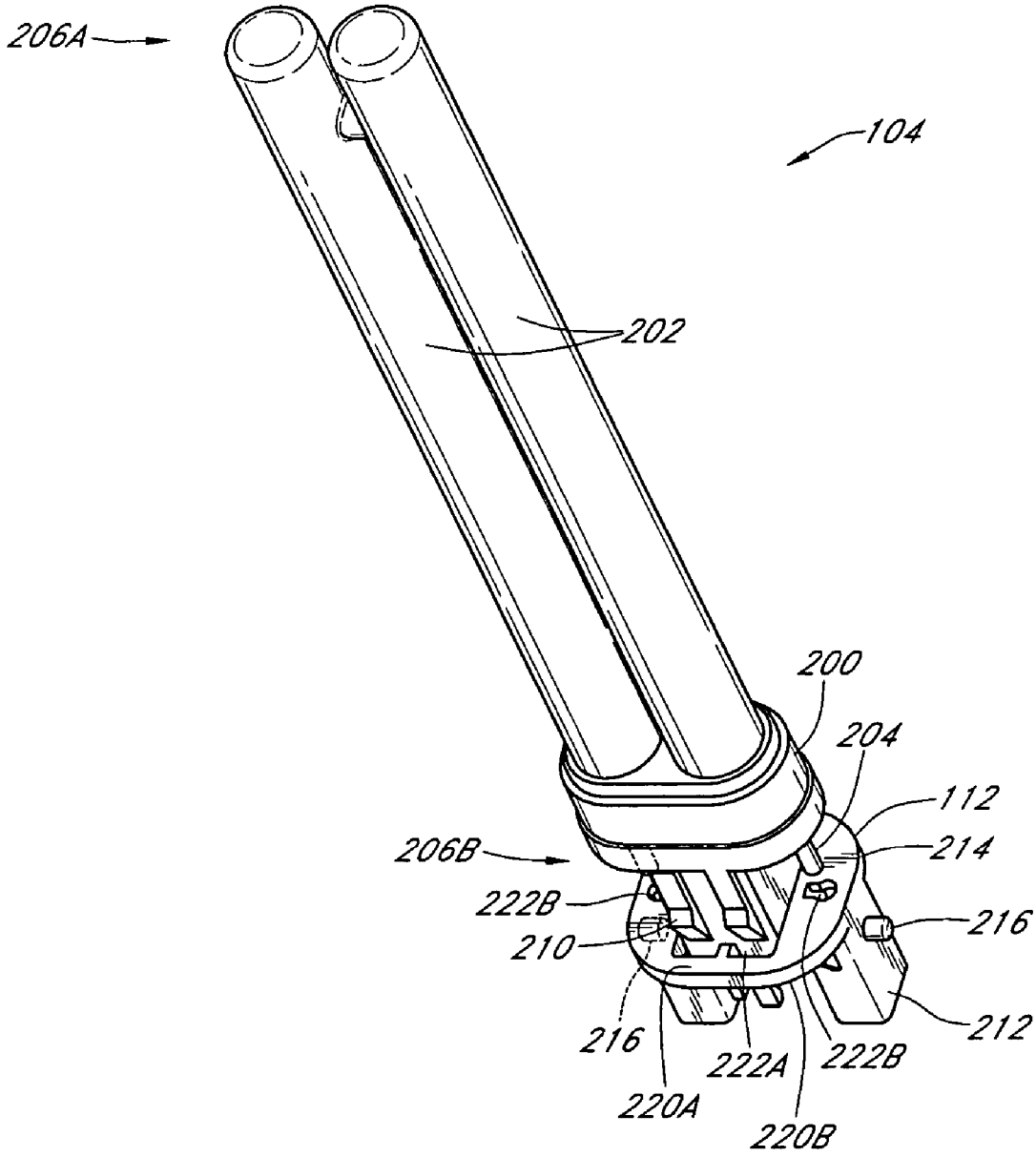
FIG. 2A is a perspective view of one embodiment of a fluorescent bulb used in the light of FIGS. 1A-1B.
Figure 2B:
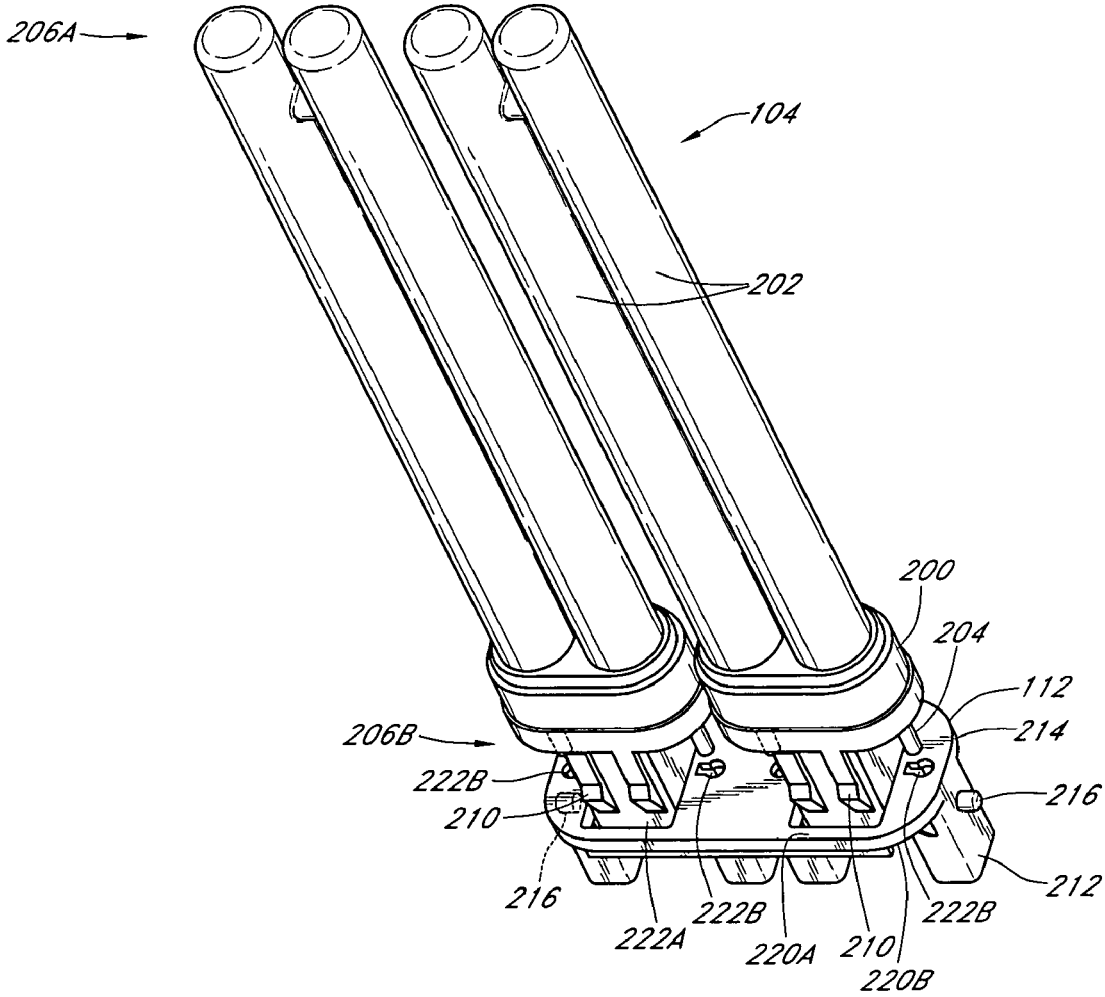
FIG. 2B is a perspective view of an alternative embodiment of a fluorescent bulb that can be used in the light of FIGS. 1A-1B.

FIGS. 2A-2B illustrate embodiments of the light bulb 104 and mounting assembly 112. In general, the light bulb 104 is placed within the assembly 112, mechanically securing the bulb 104 to the assembly 112 and bringing the bulb 104 in electrical communication with the electrical components 154 of the light 100. The assembly 112 is configured such that when the bulb 104 and the assembly 112 are placed within the handle 102, the assembly 112 may move so as to allow a portion of the bulb 104 to emerge from the aperture 134 for removal and replacement of the bulb 104, as will be discussed in greater detail below with respect to FIG. 3A-3B. This design provides improved access to the bulb 104 for replacement, as well as reducing the exposure to electrical components 154, allowing the user to replace the bulb 104 safely.

FIG. 2A illustrates one embodiment of a light bulb 104 which is partially inserted within the assembly 112. In a preferred embodiment, the bulb 104 comprises a fluorescent bulb, such as, for example, a 26 Watt PI-style fluorescent bulb. The bulb 104 is generally elongate, possessing a bulb base 200, a plurality of light elements 202, electrical prongs 204, a bulb first end 206A and a bulb second end 206B, and mounting clips 210. The base 200 is interconnected to the light elements 202 about the bulb second end 206B. The mounting clips 210 extend outward from the base 200, opposite the light elements 202 in order to mechanically engage the assembly 112 and secure the bulb 104 to the assembly 112. The electrical prongs 204, which are in electrical communication with the light elements 202, also extend outward from the base 200, opposite the light elements 202. When inserted in the assembly 112, the prongs 204 engage electrical contacts within the assembly, electrically interconnecting the bulb 104 to the electrical components.

FIG. 2A also illustrates one embodiment of the mounting assembly 112. The mounting assembly 112 generally comprises two posts 212, a flange 214, and a two pivot pins 216. The flange 214 is generally rectangular, possessing a first face 220A, a second face 220B, and a plurality of sockets 222A and 222B. In a preferred embodiment, the flange 214 is dimensioned so as to span the handle interior 118, inhibiting access to the electrical components 154 within the handle 102, as discussed in greater detail below with respect to FIG. 3A-3B. The posts 212 are generally rectangular and hollow, interconnected to the second face 220B of the flange 214 and extending approximately perpendicular to the flange 214. In one embodiment, the pivot pins 216 are interconnected to the posts 212, extending outward, approximately perpendicular to the long axis of the posts 212. In one embodiment also discussed in greater detail below with respect to FIGS. 3A-3B, the assembly 112 may be placed within the handle 102 such that the pivot pins 216 allow the assembly 112 to pivot and move a portion of the light bulb 104 outside the housing 106 for replacement.

In one embodiment, the assembly 112 is further configured to removeably retain the light bulb 104. The first socket 222A in the assembly 112 is dimensioned to receive a portion of the base 200 and lockingly engage the locking tabs 210. The second set of sockets 222B in the assembly 112 is dimensioned to receive the electrical prongs 204 of the light bulb 104. The sockets 222B further incorporate electrical contacts which are in electrical communication with the electrical components 154 and receive the electrical prongs 204.

It may be understood, however, that embodiments of the assembly 112 are not limited to accepting a single bulb 104, however. The assembly 112 may be configured to accept a predetermined number of light bulbs 104, as necessary. In an alternative embodiment, illustrated in FIG. 2B, the mounting assembly 112 is configured to house two light bulbs 100. In this embodiment, the flange 214 is extended in length, compared to the single bulb assembly 112 of FIG. 2A, and provided with two sockets 222A, 222B and four posts 212.

Figure 3A:
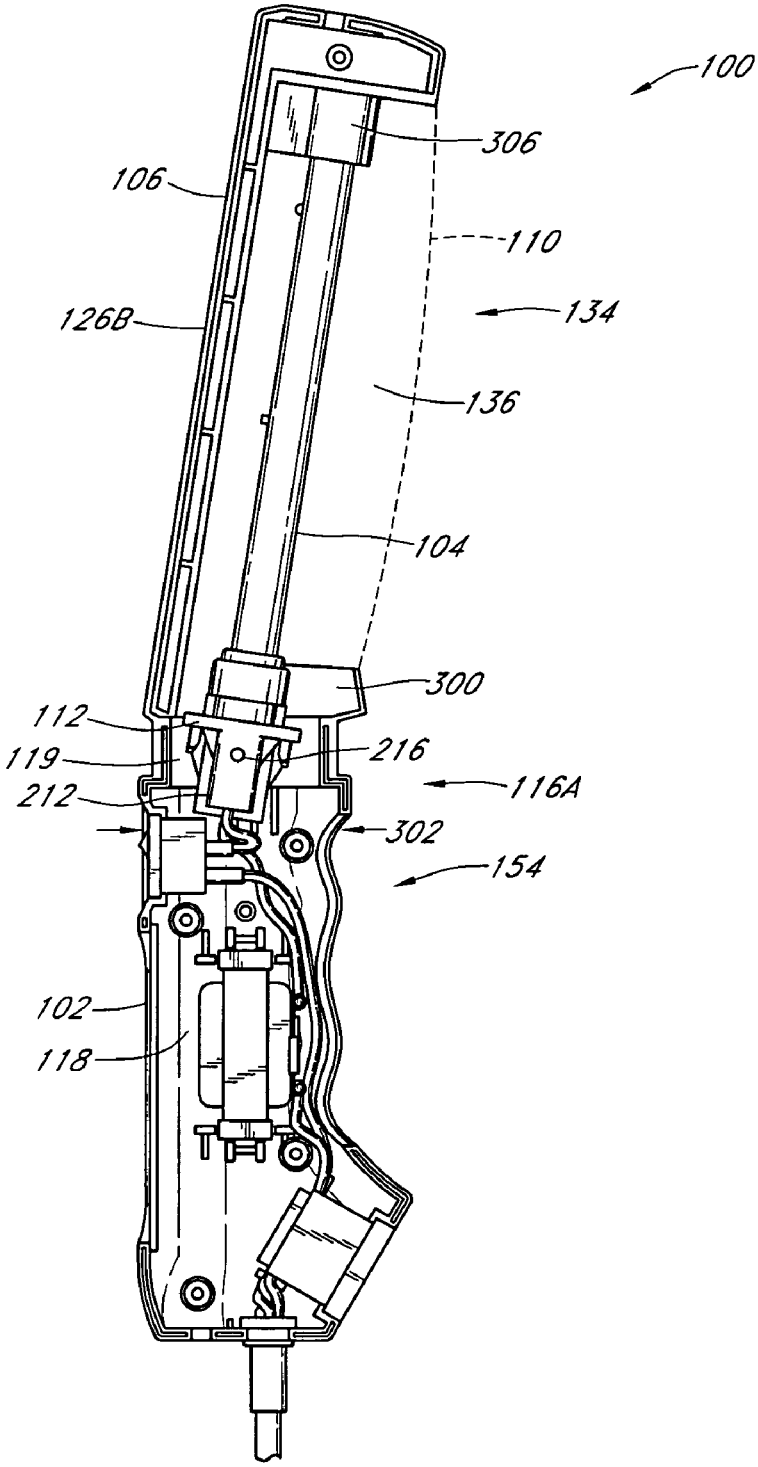
FIG. 3A is an interior sectional view of the handheld portable light of FIG. 1A, illustrating the light bulb in a retracted position.
Figure 3B:
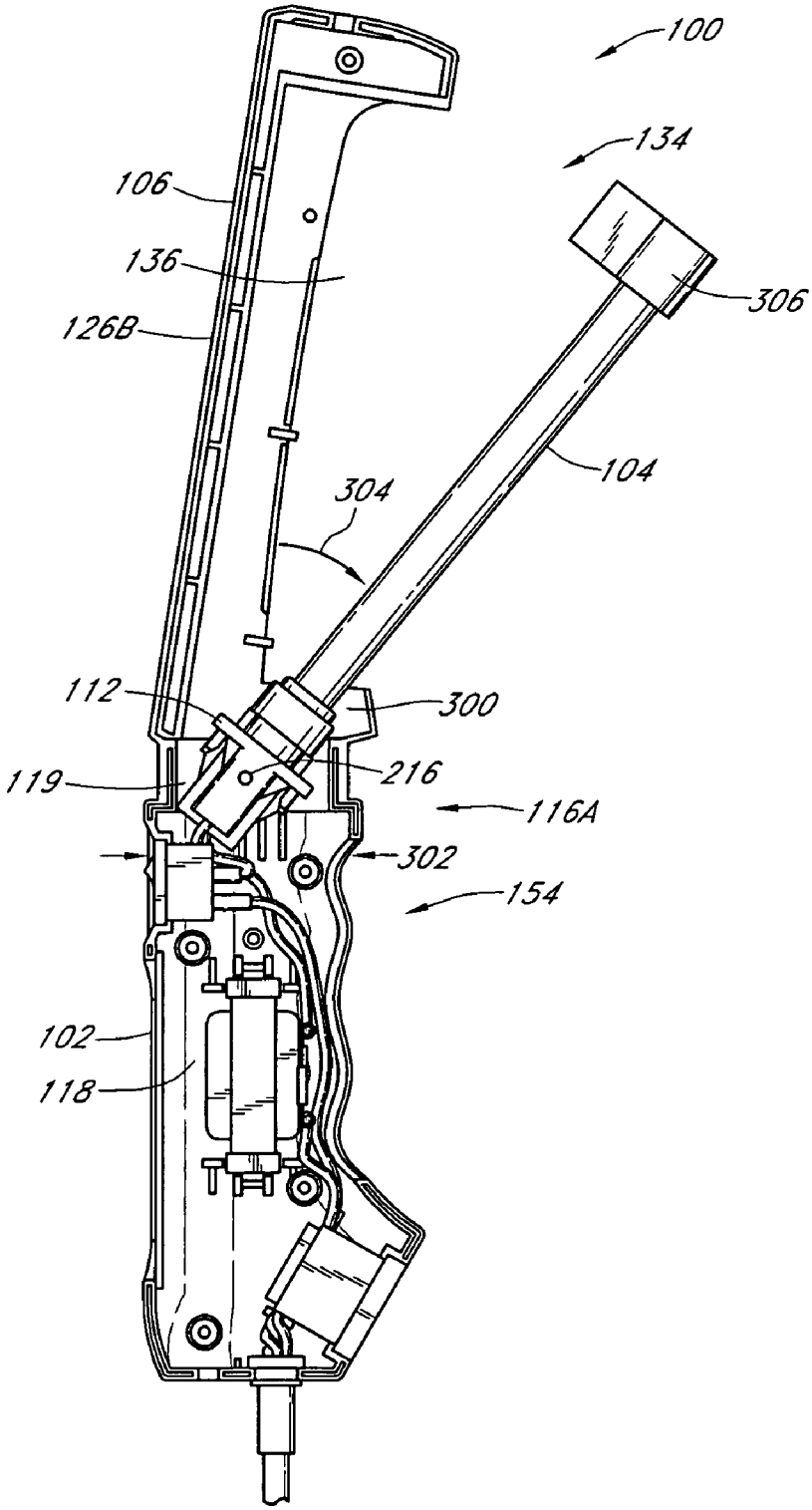
FIG. 3B is an interior sectional view of the handheld portable light of FIG. 1A, illustrating the light bulb in an extended position.

FIGS. 3A-3B illustrate interior sectional views of one embodiment of the mounting assembly 112 and bulb 104 mounted within the handle opening 119, in retracted position and extended positions. The mounting assembly 112 is positioned within the handle interior 118, adjacent to the handle first end 116A where the pivot pins 216 engage holes in the handle interior 118 which allow the mounting assembly 112 to pivot. When the light 100 is in use, the bulb 104 is positioned in the retracted position, as illustrated in FIG. 3A, the bulb 104 is positioned substantially within the housing interior 136, approximately parallel to the housing second face 126B, and the cover 110 is placed within the aperture 134. So positioned, the bulb 104 is protected by the housing first and second halves 126A and 126B and the cover 110 from contact with objects which may damage the bulb 104. When the bulb 104 is to be replaced, the tabs 140A and 140B and screws 142 are removed from the housing 106 and cover 110 is removed from the aperture 134. The bulb 104 is then pivoted into the extended position, as illustrated in FIG. 3B, where at least a portion of the bulb 104 extends outside the housing interior 136, through the aperture 134. In alternative embodiments, the mounting assembly 112 may be configured so as to move by sliding, rotation, or other forms of motion which cause a portion of the bulb 104 to extend outside the housing interior 136.

Advantageously, when in the extended position, the bulb 104 may be easily removed from the mounting assembly 112 for replacement. With the cover 110 moved from the aperture 134 and a portion of the bulb 104 extending out from the housing interior 136, as illustrated in FIG. 3B, the bulb 104 is substantially accessible from all sides. A user of the light 100 may therefore grasp the bulb 104 with ease and remove the bulb 104 from the light 100, regardless of the size of their hands. In this manner, the user avoids the problem of inadequate space for accessing the bulb 104 and substantially reduces the risk of bulb breakage and injury when replacing the bulb 104. After replacement of the bulb 104, the light 100 is readied for further use by returning the bulb 104 to the retracted position, replacing the cover 110 within the aperture 134, and re-engaging the screws 142.

In certain embodiments, the light 100 is also configured to inhibit access to the electrical components 154 in both the retracted and extended positions, reducing the user's risk of electrocution when changing the bulb 104. When changing a bulb 104, the user may neglect to disconnect the light 100 from the electrical power source. Thus, when the user opens the cover 110 to replace the light 100, they risk electrocution if they contact any portion of the current carrying electrical components 154. In one embodiment, illustrated in FIGS. 3A-3B, the mounting assembly 112 is positioned below the handle opening 119, restricting the user's access to the electrical components 154 which are positioned below the mounting assembly 119.

The mounting assembly 112 itself may also be configured so as to inhibit the user's access to the electrical components 154. In one embodiment, the assembly 112 is dimensioned so as to substantially span a handle diameter 302 in both the retracted an extended positions. Therefore, the fingers of a user or a child will be inhibited from contacting the electrical components 154 by the mounting assembly 112. In another embodiment, the electrical wires 156 interconnected to the electrical contacts in the assembly 112, are substantially surrounded by the mounting assembly posts 212 and inaccessible to the user, reducing the user's risk of electrocution.

In another embodiment, the extent to which the bulb 104 may pivot is limited to inhibit user access to the electrical components 154. In certain portable light designs, the light bulb may be moved up to about 90 degrees from the retracted position to the extended position. When the light bulb is moved through large angles approaching 90 degrees, the light bulb mounting becomes increasingly exposed to the user. Electrical components, such as wires connecting the electrical contacts within mounting to the power source, also become increasingly exposed to the user, increasing the user's risk of electrocution when replacing the bulb. As illustrated in FIGS. 3A-3B, however, the handle first end 116A is configured with a lip 300 adjacent to the first end 116A. As the mounting assembly 112 moves from the retracted to extended positions, the lip 300 contacts the mounting assembly 112 and inhibits further motion of the assembly 112 and the light bulb 104. In a preferred embodiment, the angle 304 is less than about 90 degrees. In a more preferred embodiment, the angle 304 is about 30 degrees. In this manner, the bulb 104 is inhibited from pivoting through an angle 304 which substantially exposes the electrical components 154 to the user and reduces the user's risk of electrocution.

In one embodiment, illustrated in FIG. 3A, a removably attachable light bulb guard 306 may be optionally utilized in conjunction with the bulb 104 to protect the bulb 104 from damage and further protect the user from injury. As illustrated in FIG. 3A, the bulb 104 is inserted within the bulb guard 306 at approximately the bulb first end 206A. The bulb guard 306 is dimensioned such that the affixed bulb guard 306 is positioned adjacent to, and substantially in contact with, the housing first end 130A and second face 126B when the bulb 104 is in the retracted position. This configuration secures the bulb 104 to the housing 106 in a press-fit type or friction connection. In a preferred embodiment, the guard 306 is fabricated from an elastomer or other compliant material. When the bulb 104 experiences a force that causes it to move during use of the light 100, such as when the light 100 is dropped or moved quickly, the bulb guard 306 frictionally rubs against and/or presses against the housing 106, inhibiting motion of the bulb 104 which might cause the bulb 104 contact the housing 106 or cover 110 and break. Additionally, when the cover 110 is in the disengaged position, the bulb 104 is inhibited from moving out of the housing interior 136 until the user moves the bulb 104 from the retracted to extended positions. In this manner, the bulb guard 306 protects the bulb 104 from damage and spares user the necessity of replacing a broken bulb, which may possess sharp pieces or hazardous mercury that might cause the user injury.

Although the foregoing description of the preferred embodiments of the present invention has shown, described and pointed out the fundamental novel features of the invention, it will be understood that various omissions, substitutions, and changes in the form of the details of the invention as illustrated as well the uses thereof, may be made by those skilled in the art, without departing from the spirit of the invention. Consequently, the scope of the invention should not be limited to the foregoing discussions but should be defined by the following claims.

What is claimed is:

1. A hand-held portable drop light, comprising:

a handle having a first and a second end wherein the handle defines a handle interior accessible through an opening formed in the first end and wherein the handle contains a plurality of electrical components for operation of the light;

a housing interconnected to the first end of the handle, wherein the housing defines a housing interior dimensioned so as to accommodate a light bulb, and wherein an aperture is formed within the housing which allows access to the handle interior;

a cover, wherein the cover is configured so as to move between an engaged position, wherein the cover substantially spans the housing aperture so as to inhibit access to the housing interior, and a disengaged position wherein at least a portion of the cover is removed from the aperture so as to allow access to the housing interior;

a mounting assembly positioned adjacent to the handle opening, wherein the mounting assembly is configured so as to removeably retain the light bulb and wherein the mounting assembly is moveable independent of the cover about a fixed pivot point between a retracted position, where the light bulb is positioned substantially within the housing interior, and an extended position, where at least a portion of the light bulb extends through the aperture when the cover is in the disengaged position, to thereby permit a user to grasp the light bulb from at least two sides to remove the light from the mounting assembly for replacement purposes without the cover being interposed between the two lateral sides of the light bulb and the user's hand; and said handle further comprising a lip which inhibits the mounting assembly from pivoting the light bulb through greater than a predetermined angle from the retracted to extended positions so as to inhibit access to the electrical components through the handle opening.

2. The light of claim 1, wherein the light bulb is a fluorescent light bulb.

3. The light of claim 1, wherein at least a portion of the light bulb in the extended position extends through the aperture when the cover is in the disengaged position, to thereby permit a user to grasp the light bulb from substantially all sides to remove the light bulb from the mounting assembly for replacement purposes.

4. The light of claim 1, wherein the cover is detached from light when in the disengaged position.

5. The light of claim 1, wherein the mounting assembly pivots in order to move between the retracted and extended positions.

6. The light of claim 1, wherein the predetermined angle is less than approximately 90 degrees.

7. The light of claim 1, wherein the predetermined angle is approximately 30 degrees.

8. The light of claim 1, wherein the mounting assembly is dimensioned so as to substantially span the handle opening so as to substantially inhibit access to electrical components housed within the handle interior through the handle opening.

9. The light of claim 1, further comprising a removeably attachable light bulb guard, wherein the bulb guard is positioned approximately on the first end of the light and substantially contacts the housing so as to inhibit movement of the light bulb.

* * * * *